US008117859B2

(12) United States Patent
Chessel et al.

(10) Patent No.: US 8,117,859 B2
(45) Date of Patent: Feb. 21, 2012

(54) METHODS AND SYSTEMS FOR CONTROLLING AIR CONDITIONING SYSTEMS HAVING A COOLING MODE AND A FREE-COOLING MODE

(75) Inventors: Julien Chessel, Villieu Loyes Mollon (FR); Pierre Delpech, Fleurier-sur-Saone (FR); Jean-Philippe Goux, Toussieu (FR)

(73) Assignee: Carrier Corporation, Farmington, CT (US)

( * ) Notice: Subject to any disclaimer, the term of this patent is extended or adjusted under 35 U.S.C. 154(b) by 96 days.

(21) Appl. No.: 12/520,823

(22) PCT Filed: Dec. 22, 2006

(86) PCT No.: PCT/US2006/049170

§ 371 (c)(1),
(2), (4) Date: Jun. 22, 2009

(87) PCT Pub. No.: WO2008/079119

PCT Pub. Date: Jul. 3, 2008

(65) Prior Publication Data

US 2010/0094465 A1 Apr. 15, 2010

(51) Int. Cl.
*F25B 49/00* (2006.01)

(52) U.S. Cl. ..... 62/228.3; 62/99; 62/228.5; 62/430

(58) Field of Classification Search ..... 62/99, 228.3, 62/228.5, 430, DIG. 22
See application file for complete search history.

(56) References Cited

U.S. PATENT DOCUMENTS

| | | | | |
|---|---|---|---|---|
| 3,640,084 | A * | 2/1972 | Hopkins et al. | 62/101 |
| 4,787,213 | A * | 11/1988 | Gras et al. | 62/212 |
| 4,974,420 | A * | 12/1990 | Kramer | 62/115 |
| 5,884,493 | A * | 3/1999 | Karstrom et al. | 62/99 |
| 6,067,805 | A * | 5/2000 | Porter et al. | 62/125 |

FOREIGN PATENT DOCUMENTS

| | | | |
|---|---|---|---|
| CN | 01278831.7 | | 12/2002 |
| EP | 0937950 | A2 | 8/1999 |
| WO | W02004/102086 | A1 | 11/2004 |

OTHER PUBLICATIONS

PCT/US06/49170, Form PCT/ ISA/210, mailed Oct. 23, 2007.

* cited by examiner

*Primary Examiner* — Frantz Jules
*Assistant Examiner* — Daniel C Comings
(74) *Attorney, Agent, or Firm* — Cantor Colburn LLP

(57) ABSTRACT

An air conditioning system having a cooling mode and a free-cooling mode. The system having a refrigeration circuit having a compressor and a pump; a suction pressure sensor for measuring a suction pressure of the compressor; a discharge pressure sensor for measuring a discharge pressure of the compressor; a controller for selectively operating in the cooling mode by circulating and compressing a refrigerant through the refrigeration circuit via the compressor or operating in the free-cooling mode by circulating the refrigerant through the refrigeration circuit via the pump; and a recover-refrigerant sequence resident on the controller, the recover-refrigerant sequence being configured to pump the refrigerant in a portion of the refrigeration circuit not used in the free-cooling mode to remaining portions of the refrigeration circuit used in the free-cooling mode when the controller switches from the cooling mode to the free-cooling mode.

9 Claims, 3 Drawing Sheets

METHODS AND SYSTEMS FOR CONTROLLING AIR CONDITIONING SYSTEMS HAVING A COOLING MODE AND A FREE-COOLING MODE

BACKGROUND OF THE INVENTION

1. Field of the Invention

The present disclosure is related to air conditioning systems. More particularly, the present disclosure is related to methods and systems for controlling air conditioning systems having a free-cooling mode and a cooling mode.

2. Description of Related Art

During the typical operation of air conditioning systems, the system is run in a cooling mode wherein energy is expended by operating a compressor. The compressor compresses and circulates a refrigerant to chill or condition a working fluid, such as air or other secondary loop fluid (e.g., chilled water or glycol), in a known manner. The conditioned working fluid can then be used in a refrigerator, a freezer, a building, an automobile, and other spaces with climate controlled environment.

However, when the outside ambient temperature is low, there exists the possibility that the outside ambient air itself may be utilized to provide cooling to the working fluid without engaging the compressor. When the outside ambient air is used by an air conditioning system to condition the working fluid, the system is referred to as operating in a free-cooling mode.

As noted above, traditionally, even when the ambient outside air temperature is low, the air conditioning system is run in the cooling mode. Running in cooling mode under such conditions provides a low efficiency means of conditioning the working fluid. In contrast, running the air conditioning system under such conditions in a free-cooling mode is more efficient. In the free-cooling mode, one or more ventilated heat exchangers and pumps are activated so that the refrigerant is circulated by the pumps and is cooled by the outside ambient air. In this manner, the refrigerant, cooled by the outside ambient air, can be used to cool the working fluid without the need for the low efficiency compressor.

Accordingly, it has been determined by the present disclosure that there is a need for methods and systems that improve the efficiency of air conditioning systems having a free-cooling mode.

BRIEF SUMMARY OF THE INVENTION

An air conditioning system having a cooling mode and a free-cooling mode. The system having a refrigeration circuit having a compressor and a pump; a suction pressure sensor for measuring a suction pressure of the compressor; a discharge pressure sensor for measuring a discharge pressure of the compressor; a controller for selectively operating in the cooling mode by circulating and compressing a refrigerant through the refrigeration circuit via the compressor or operating in the free-cooling mode by circulating the refrigerant through the refrigeration circuit via the pump; and a recover-refrigerant sequence resident on the controller, the recover-refrigerant sequence being configured to pump the refrigerant in a portion of the refrigeration circuit not used in the free-cooling mode to remaining portions of the refrigeration circuit used in the free-cooling mode when the controller switches from the cooling mode to the free-cooling mode.

A method of controlling an air conditioning system having a cooling mode and a free-cooling mode is provided. The method includes switching the air conditioning system to the free-cooling mode; initiating a recover-refrigerant sequence to recover refrigerant from a portion of a refrigeration circuit that is not used during the free-cooling mode but is used during the cooling mode; and maintaining the air conditioning system in the free-cooling mode after completion of the recover-refrigerant sequence.

The above-described and other features and advantages of the present disclosure will be appreciated and understood by those skilled in the art from the following detailed description, drawings, and appended claims.

DETAILED DESCRIPTION OF THE INVENTION

Figure 2:
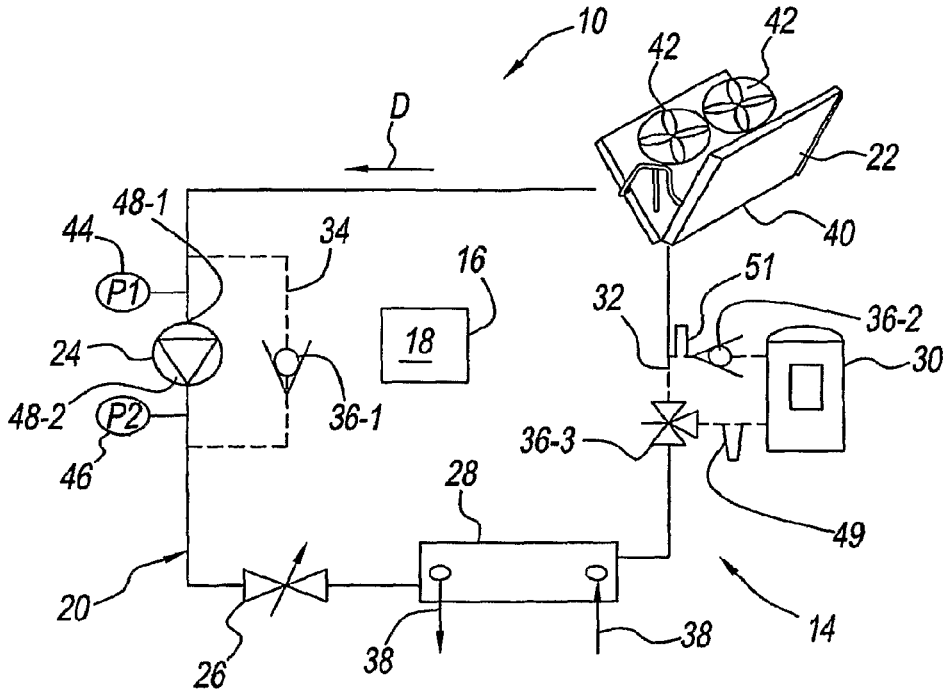
FIG. 2 is an exemplary embodiment of an air conditioning system in free-cooling mode according to the present disclosure.
Figure 1:
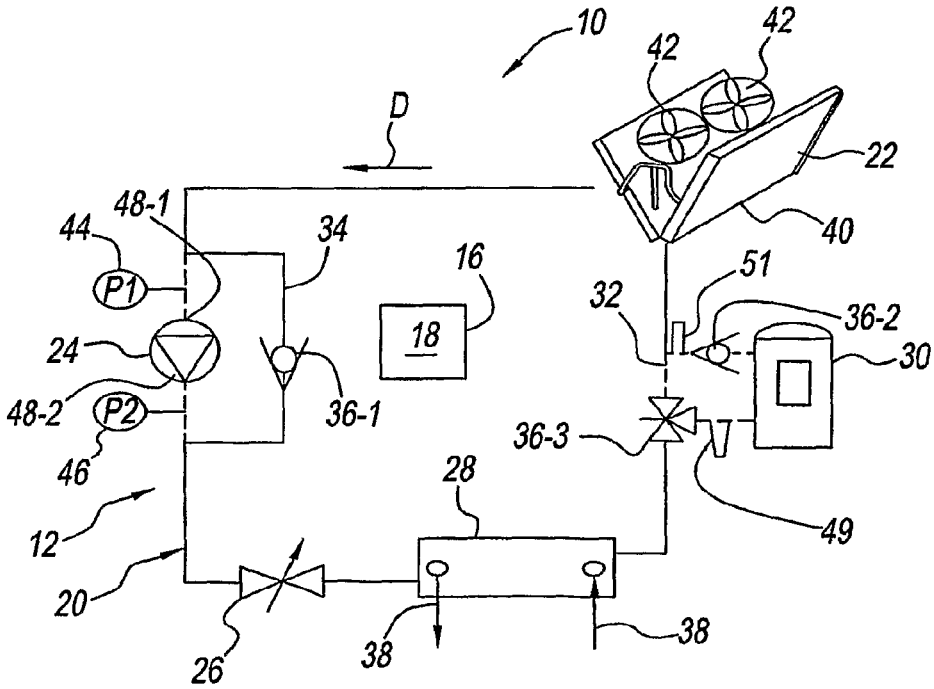
FIG. 1 is an exemplary embodiment of an air conditioning system in cooling mode according to the present disclosure.

Referring now to the drawings and in particular to FIGS. 1 and 2, an exemplary embodiment of an air conditioning system ("system") according to the present disclosure, generally referred to by reference numeral 10, is shown. System 10 is configured to operate in a cooling mode 12 (FIG. 1) and a free-cooling mode 14 (FIG. 2).

System 10 includes a controller 16 for selectively switching between cooling and free-cooling modes 12, 14. Advantageously, controller 16 includes a refrigerant-recovery sequence 18 ("sequence") resident thereon that monitors pressure in system 10 during the switchover from cooling mode 12 to free-cooling mode 14. In this manner, system 10 recovers refrigerant from system 10 components that are used in cooling mode 12, but not in free-cooling mode 14. This allows the pump to operate during the initiation of free-cooling mode 14 and improves pump reliability.

System 10 also includes a refrigeration circuit 20 that includes a condenser 22, a pump 24, an expansion device 26, an evaporator 28, and a compressor 30. Controller 16 is configured to selectively control either compressor 30 (when in cooling mode 12) or pump 24 (when in free-cooling mode 14) to circulate a refrigerant through system 10 in a flow direction (D). Thus, system 10, when in cooling mode 12, controls compressor 30 to compress and circulate the refrigerant in flow direction 30. However, system 10, when in free-cooling mode 14, controls pump 24 to circulate the refrigerant in flow direction 30. As such, free-cooling mode 14 uses less energy then cooling mode 12 since the free-cooling mode does not require the energy expended by compressor 30. Moreover, System 10 includes a suction pressure sensor 49 and a discharge pressure sensor 51.

System 10 includes a compressor by-pass loop 32 and a pump by-pass loop 34. System 10 includes one or more valves 36-1, 36-2, and 36-3. In one embodiment of the present disclosure valve 36-3 is a three-way valve. Valves 36 are controlled by controller 16 in a known manner. Thus, controller 16 can selectively position valves 36 to selectively open and close by-pass loops 32, 34 as desired.

In cooling mode 12, controller 16 controls valves 36 so that compressor by-pass loop 32 is closed and pump by-pass loop 34 is open. In this manner, system 10 is configured to allow compressor 30 to compress and circulate refrigerant in the flow direction D by flowing through pump by-pass loop 34.

In contrast, controller 16, when in free-cooling mode 14, controls valves 36 so that compressor by-pass loop 32 is open and pump by-pass loop 34 is closed. In this manner, system 10 is configured to allow pump 24 to circulate refrigerant in the flow direction D by flowing through compressor by-pass loop 32.

Accordingly, system 10 can condition (i.e., cool and/or dehumidify) a working fluid 38 in heat-exchange communication with evaporator 28 in both cooling and free-cooling modes 12, 14. Working fluid 38 can be ambient indoor air or a secondary loop fluid such as, but not limited to, chilled water or glycol.

In cooling mode 12, system 10 operates as a standard vapor-compression air conditioning system known in the art where the compression and expansion of refrigerant via expansion device 26 are used to condition working fluid 38. Expansion device 26 can be any known controllable expansion device such as, but not limited to a thermal expansion valve.

In free-cooling mode 14, system 10 takes advantage of the heat removing capacity of outdoor ambient air 40, which is in heat exchange relationship with condenser 22 via one or more fans 42, to condition working fluid 38.

Although system 10 is described herein as a conventional air conditioning (cooling) system, one skilled in the art will recognize that system 10 may also be configured as a heat pump system to provide both heating and cooling, by adding a reversing valve (not shown) so that condenser 22 (i.e., the outdoor heat exchanger) functions as an evaporator in the heating mode and evaporator 28 (i.e., the indoor heat exchanger) functions as a condenser in the heating mode.

It has been determined by the present disclosure that refrigerant leaving condenser 22 can be in one of several different phases, namely a gas phase, a liquid-gas phase, or a liquid phase. When controller 16 switches system 10 to free-cooling mode 14, pump 24 is supplied with refrigerant in the different phases until the system reaches a state of equilibrium in full circuit.

After controller 16 initiates free-cooling mode 14 and during the time it takes for system 10 to reach equilibrium, pump 24 is supplied with refrigerant in the different phases. Unfortunately, when pump 24 is supplied with refrigerant in the gas or liquid-gas phases, the pump does not operate as desired. Moreover, the gas phase and/or liquid-gas phase refrigerant can cause pump 24 to cavitate, which can damage the pump and/or the pump motor (not shown).

Turning off pump 24 would stop the potential damage from such cavitation, but also would result in delaying the ability for system 10 to easily switch from cooling mode 12 to free-cooling mode 14. Advantageously, controller 16 includes sequence 18 that functions to recover refrigerant from system 10 components that are not used during free-cooling mode 14 during the time when system 10 switches out of cooling mode 12 and into free-cooling mode 14.

System 10 includes a first pressure sensor 44, a second pressure sensor 46, a suction pressure sensor 49, and a discharge pressure sensor 51 in electrical communication with controller 16. First pressure sensor 44 is positioned at an entrance 48-1 of pump 24, while second pressure sensor 46 is positioned at an exit 48-2 of the pump. Controller 16 uses the pressures measured by first and second sensors 44, 46 to determine a pump pressure difference in real-time. Moreover, controller 16 operates compressor 30, adjusts the positions of expansion device 26 and valves 36, and monitors the pressure recorded by a third pressure sensor 49 during the switchover from cooling mode 12 to free-cooling mode 14.

Figure 3:
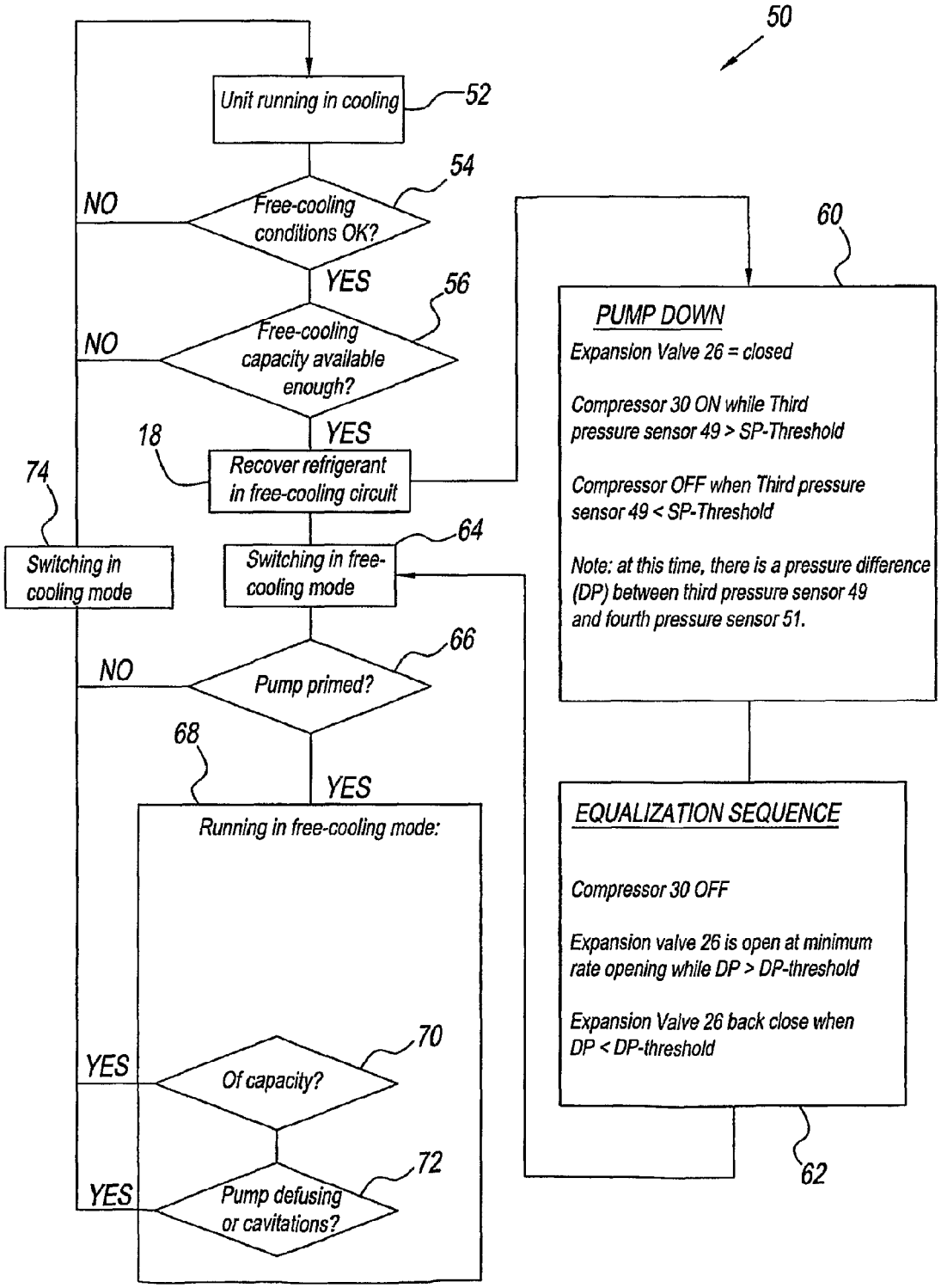
FIG. 3 illustrates an exemplary embodiment of a method of operating the air conditioning system of FIGS. 1 and 2 according to the present disclosure.

The operation of sequence 18 is described in more detail with reference to FIG. 3. FIG. 3 illustrates an exemplary embodiment of a method 50 of controlling system 10 having recover refrigerant in sequence 18 according to the present disclosure.

Method 50, when system 10 is operating in cooling mode 12, includes a first free cooling determination step 54. During first free cooling determination step 54, method 50 determines whether the temperature of ambient air 40 is sufficient for system 10 to switch to free-cooling mode 14. If so, method 50 then performs a free-cooling capacity check step 56 wherein system 10 is checked to determine if there is sufficient capacity to operate system 10 in free-cooling mode 14. If so, method 50 then performs sequence 18.

Sequence 18 includes a system pump down step 60 and a low pressure equalization step 62. Initially during sequence 18, valve 36-3 is in a position in accordance with cooling mode 12, pump 24 is off, and compressor 30 is turned off.

In pump down step 60, expansion device 26 is closed and compressor 30 is turned on. Compressor 30 remains turned on while a pressure measured by suction pressure sensor 49 is greater than a suction pressure threshold. Compressor 30 is turned off when the pressure measured by suction pressure sensor 49 is less than the suction pressure threshold. There is a pressure differential ("DP") between suction pressure sensor 49 and discharge pressure sensor 51.

In equalization sequence 62, compressor 30 is turned off. When DP is greater than a threshold pressure differential ("DP-threshold"), expansion device 26 is opened at a minimum rate. In one embodiment of the present disclosure, expansion device 26 is positioned approximately 10 percent of a full open position. Expansion device 26 will then close when DP is less than DP-threshold.

Figure 4:
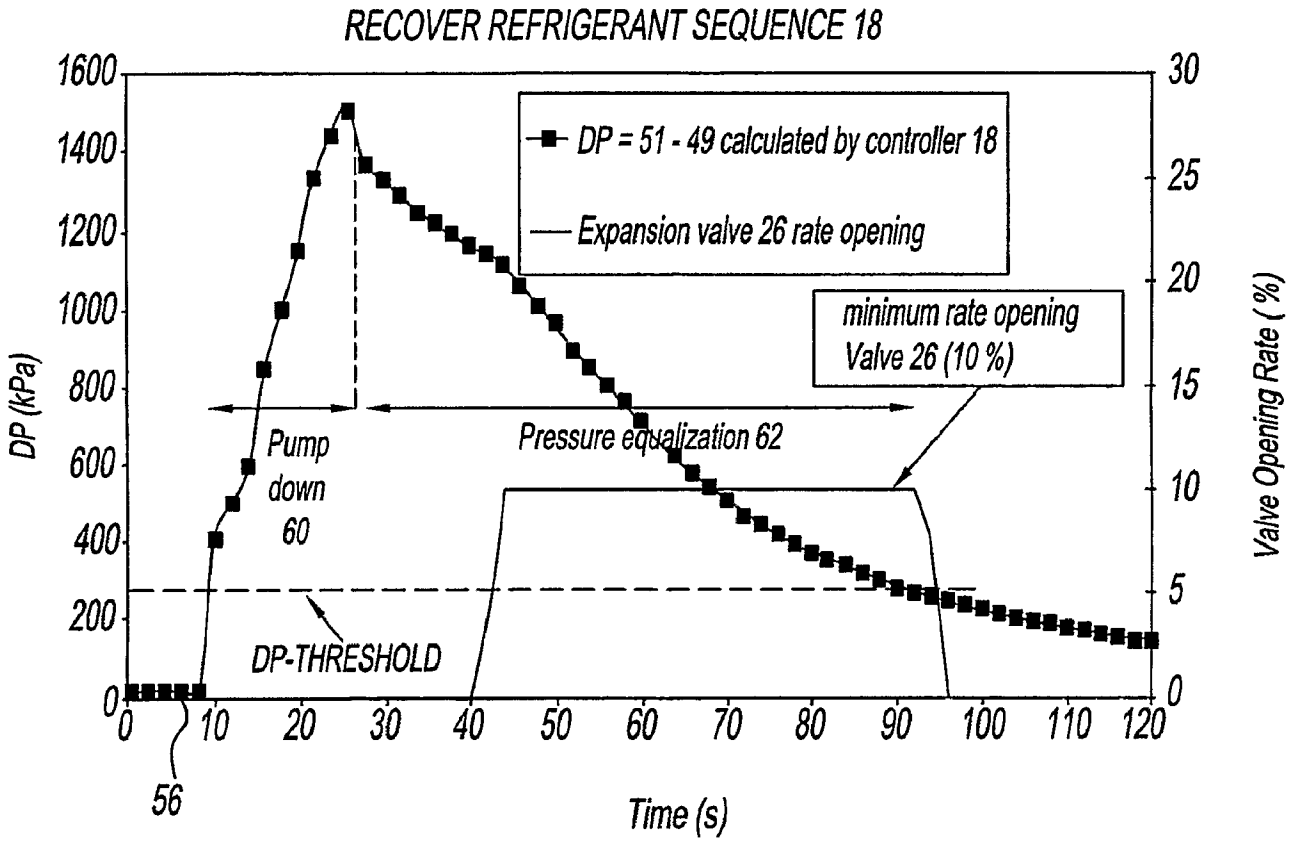
FIG. 4 illustrates a graph of an exemplary embodiment of the refrigerant recovery sequence according to the present disclosure.

Referring now to FIG. 4, a graph illustrating an exemplary embodiment of sequence 18 according to the present disclosure is shown. As can be seen, system 10 runs in free-cooling capacity check step 56 for approximately eight seconds, wherein sequence 18 is initiated. In sequence 18, initially, valve 36-3 is in a position in accordance with cooling mode 12, pump 24 is off, and compressor 30 is turned off. During pump down step 60, expansion device 26 is closed, and compressor 30 is turned on until DP equals approximately 1500 kPa. Equalization sequence 62 is then initiated, wherein expansion device 26 is opened at a minimum while DP is greater than DP-Threshold. In the illustrated embodiment, it is seen that as DP approaches DP-Threshold, the percent opening rate of expansion device 26 decreases to a value of about 3 percent opening rate.

Advantageously, it has been determined by the present disclosure that sequence 18 ensures that there is sufficient compressed refrigerant in liquid form for pump 24 to operate. This improves the reliability of pump 24 when system 10 switches into free-cooling mode 14.

After sequence 18 has been performed, method 50 switches system 10 into free cooling mode 14 at a free-cooling switching step 64.

It should be recognized that method 50 is described herein by way of example in use while system 10 is operating in cooling mode 12. Of course, it is contemplated by the present disclosure for method 50 to find equal use when system 10 is stopped such that sequence 18 avoids pump cavitation during start-up of system 10 into free-cooling mode 14 from a stopped state.

After free-cooling switching step 64, method 50 includes a pump priming step 66. After pump 24 has been primed by step 66, method 50 runs in free-cooling mode 14 at step 68. System 10 continues to run in free-cooling mode 14 until either controller 16 determines that there is a lack of system capacity at a second capacity determination step 70 or determines that pump 24 is defusing or cavitating at a pump protection step 72. If either of these conditions are determined to be present, method 50 switches system 10 into cooling mode 12 at a cooling mode switching step 74.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An air conditioning system having a cooling mode and a free-cooling mode, comprising:

a refrigeration circuit having a compressor and a pump;

a suction pressure sensor for measuring a suction pressure of said compressor;

a discharge pressure sensor for measuring a discharge pressure of said compressor;

a controller for selectively operating in the cooling mode by circulating and compressing a refrigerant through said refrigeration circuit via said compressor or operating in the free-cooling mode by circulating said refrigerant through said refrigeration circuit via said pump; and a recover-refrigerant sequence resident on said controller, said recover-refrigerant sequence being configured to pump the refrigerant in a portion of said refrigeration circuit not used in the free-cooling mode to remaining portions of said refrigeration circuit used in the free-cooling mode when said controller switches from the cooling mode to the free-cooling mode;

wherein said refrigeration circuit further comprises an controllable expansion device, said recover-refrigerant sequence being configured to maintain said expansion device in a predetermined open position until a pressure differential across said compressor reaches a threshold pressure differential, the controllable expansion device being restricted when the pressure differential across said compressor reaches the threshold pressure differential.

2. The air conditioning system of claim 1, wherein said refrigeration circuit further comprises a three-way valve, said controller adjusting an alignment of said three-way valve so that the refrigerant in said portion of said refrigerant circuit not used in the free-cooling mode is pumped to remaining portions of said refrigeration circuit used in the free-cooling mode when said controller switches from the cooling mode to the free-cooling mode.

3. The air conditioning system of claim 1, wherein said recover-refrigerant sequence is configured to turn off said compressor when said suction pressure reaches a suction pressure threshold.

4. The air conditioning system of claim 1, wherein said recover-refrigerant sequence is initiated when the air conditioning system is in an off state.

5. The air conditioning system of claim 1, wherein said recover-refrigerant sequence is initiated when the air conditioning system is operating in the cooling mode.

6. The air conditioning system of claim 1, wherein said refrigeration circuit further comprises an evaporator in heat exchange communication with said refrigerant and a working fluid.

7. The air conditioning system of claim 6, wherein said working fluid comprises ambient indoor air.

8. The air conditioning system of claim 6, wherein said working fluid comprises a secondary loop fluid.

9. The air conditioning system as in claim 1, wherein said controllable expansion device is controlled by said controller.

* * * * *